US008683991B2

(12) United States Patent
Gasparini

(10) Patent No.: US 8,683,991 B2
(45) **Date of Patent: *Apr. 1, 2014**

(54) COOKING TOP

(75) Inventor: Alberto Gasparini, Fabriano (IT)

(73) Assignee: Indesit Company, S.p.A., Fabriano (IT)

( * ) Notice: Subject to any disclaimer, the term of this patent is extended or adjusted under 35 U.S.C. 154(b) by 227 days.

This patent is subject to a terminal disclaimer.

(21) Appl. No.: 12/528,556

(22) PCT Filed: Oct. 29, 2007

(86) PCT No.: PCT/IB2007/003331

§ 371 (c)(1),
(2), (4) Date: Aug. 25, 2009

(87) PCT Pub. No.: WO2008/104832

PCT Pub. Date: Sep. 4, 2008

(65) Prior Publication Data

US 2010/0326420 A1 Dec. 30, 2010

(30) Foreign Application Priority Data

Feb. 27, 2007 (IT) ..... RN2007A0013

(51) Int. Cl.
*F24C 3/00* (2006.01)
*F23D 14/12* (2006.01)

(52) U.S. Cl.
USPC ..... 126/39 E; 126/39 J; 431/328

(58) Field of Classification Search
USPC ..... 126/39 E, 39 J; 431/328
See application file for complete search history.

(56) References Cited

U.S. PATENT DOCUMENTS

| | | | | |
|---|---|---|---|---|
| 3,858,811 | A | 1/1975 | Mizerak et al. | |
| 5,152,276 | A * | 10/1992 | Brock et al. | 126/39 E |
| 5,623,917 | A | 4/1997 | Dinaso et al. | |
| 6,325,619 | B2 * | 12/2001 | Dane | 431/284 |
| 7,001,176 | B2 * | 2/2006 | Bettinzoli | 431/354 |
| 2005/0277079 | A1 | 12/2005 | Wu | |

FOREIGN PATENT DOCUMENTS

| | | | |
|---|---|---|---|
| AU | 412372 | B2 | 4/1971 |
| BE | 547098 | | 12/1959 |
| DE | 392522 | | 3/1924 |
| DE | 3918722 | | 11/1990 |
| DE | 10315343 | A1 | 10/2004 |
| EP | 0485645 | | 5/1992 |
| EP | 0552135 | A | 7/1993 |
| EP | 1132685 | | 9/2001 |
| EP | 1531304 | A | 5/2005 |

(Continued)

*Primary Examiner* — Kenneth Rinehart
*Assistant Examiner* — William Corboy
(74) *Attorney, Agent, or Firm* — Cesari and McKenna, LLP

(57) ABSTRACT

A cooking top, in particular a cooking top suitable for household use, comprises: an upward facing top cover, a first gas burner in turn comprising first flame divider means which put the first burner in operative communication with the outside of the top cover, the flame divider means comprising first flame outlets in turn comprising outlet sections, said outlet sections defining a first crown which defines and at least partly surrounds a first portion of the cooking top, and a second gas burner in turn comprising second flame divider means in operative communication with the outside of the top cover, the second flame divider means comprising second flame outlets in turn comprising outlet sections, the second flame divider means being formed in the first portion of the cooking top, the first and the second flame divider means being separate and independent of each other with the outlet sections of the first and/or second flame outlets facing upwards at least partly.

16 Claims, 4 Drawing Sheets

(56) References Cited

FOREIGN PATENT DOCUMENTS

| | | | | | |
|---|---|---|---|---|---|
| FR | 432193 | | 11/1911 | | |
| FR | 2404803 | | 4/1979 | | |
| FR | 2414681 | | 8/1979 | | |
| GB | 2223302 | | 4/1990 | | |
| GB | 2233444 | A | 1/1991 | | |
| GB | 2280743 | | 2/1995 | | |
| JP | 61 086507 | | 5/1986 | | |
| WO | WO 93/18342 | * | 9/1993 | ..... | F23D 14/16 |
| WO | WO 2005/078342 | | 8/2005 | | |
| WO | WO 2007/012766 | | 2/2007 | | |
| WO | WO 2008/104831 | | 9/2008 | | |

* cited by examiner

COOKING TOP

TECHNICAL FIELD

This invention relates to a cooking top, especially a cooking top suitable for household use and comprising at least one gas burner.

BACKGROUND ART

The market currently offers several different types of domestic cooking tops. One of the most widely used types of cooking top includes one or more gas burners where the heat necessary for cooking food is generated by the combustion of a gas suitably mixed with air.

On 30 Sep. 2005, the Applicant filed an application, numbered TOA2005A000685, for an Italian industrial invention patent. That patent application describes a cooking top especially designed for use in the home. The top comprises an upward facing top cover, usually referred to simply as "surface" by experts in the trade. The cooking top also comprises a gas burner which in turn comprises flame divider means positioned near the top cover. The flame divider means put the first burner in operative communication with the outside of the top cover and comprise flame outlets in turn comprising upward facing outlet sections. The outlet sections of the flame outlets together form a flame crown which delimits a first portion of the cooking top. Advantageously, the crown comprises a plurality of concentric sub-crowns, each sub-crown comprising a plurality of outlet sections of the flame outlet sections.

DISCLOSURE OF THE INVENTION

The aim of this invention is to provide a cooking top which improves cooking uniformity.

Another aim of the invention is to provide a cooking top that enables heating power to be made available in a more flexible manner.

A yet further aim of the invention is to provide a cooking top with at least one considerably powerful but compact cooking point.

These and other aims, which will become more apparent in the description which follows, are achieved in accordance with the invention by a cooking top having the structural and functional characteristics described in the appended independent claims, while other embodiments of the cooking top according to the invention are described in the dependent claims.

BRIEF DESCRIPTION OF THE DRAWINGS

The invention will now be described in more detail with reference to the accompanying drawings, which illustrate non-limiting preferred embodiments of it.

DETAILED DESCRIPTION OF THE PREFERRED EMBODIMENTS OF THE INVENTION

Figure 1:
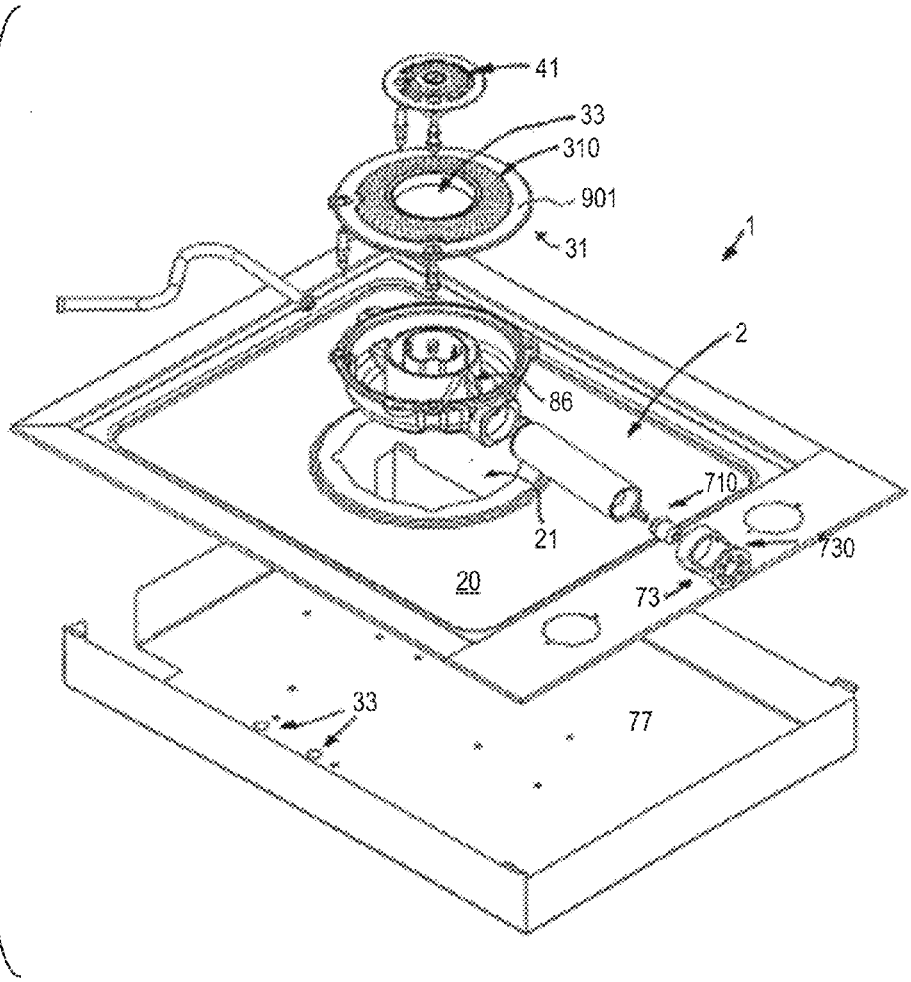
FIG. 1 is an exploded view of the cooking top according to this invention.

With reference to FIG. 1, the numeral 1 denotes a cooking top, in particular a cooking top suitable for household use and comprising an upward facing top cover 2, a first gas burner 3 and a second gas burner 4. The top cover 2 is usually referred to simply as "surface" by experts in the trade.

The first gas burner 3 in turn comprises first flame divider means 310 which put the first burner 3 in operative communication with the outside of the top cover 2. Advantageously, the first flame divider means 310 are located close to the top cover 2, and in some cases are mounted against the top cover 2. The first flame divider means 310 comprise first flame outlets 34 in turn comprising outlet sections, said outlet sections of the first flame outlets 34 together defining a first crown 32 that defines and at least partly surrounds a first portion 33 of the cooking top 1.

Figure 6:
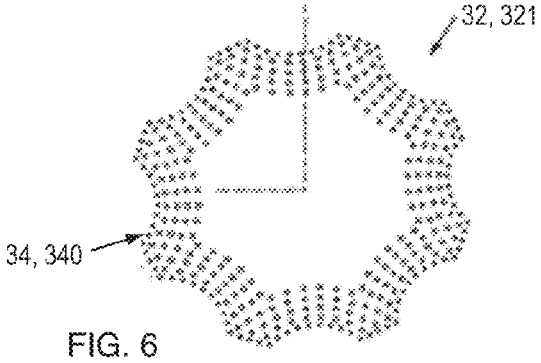
FIGS. 6 to 9 show alternative embodiments of a component of the cooking top according to the invention.
Figure 7:
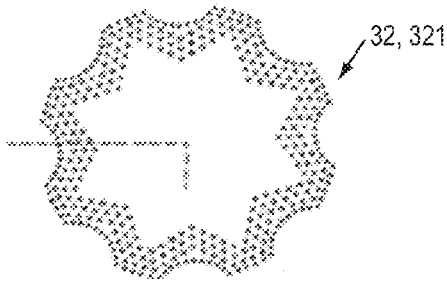

The first crown 32 may have a discoidal, polygonal or curvilinear shape, a mixed polygonal and curvilinear shape or any other geometric shape. Further, the first crown 32 may extend along a closed, unbroken line or along a broken line (the latter solution not being illustrated). In the non-limiting example embodiment illustrated in FIGS. 6 and 7, the first crown 32 is star shaped.

Advantageously, but not necessarily, the first crown 32 has the shape of a closed ring.

The second gas burner 4 in turn comprises second flame divider means 41 which put the second burner 4 in operative communication with the outside of the top cover 2, the second flame divider means 41 comprising second flame outlets 340 in turn comprising outlet sections. The second flame divider means 41 are formed in the first portion 33 of the cooking top 1. The first and the second flame divider means 310, 41 are separate and independent of each other.

The outlet sections of the first and/or the second flame outlets 34, 340 face upwards at least partly.

The provision of a first and a second burner 3 and 4 increases the total power made available for cooking and improves cooking uniformity since a larger area of the pan placed over them is heated directly. The second flame divider means 41 are located inside the first flame divider means 310 and use a space which would otherwise be unused.

The top cover 2 comprises a first surface 20, normally visible, which in turn comprises a hole 21 for accommodating the first flame divider means 310. Usually, the first surface 20 of the top cover 2 is substantially flat.

The upward orientation of the outlet sections of the first and/or the second flame outlets 34, 340 generate a flame with a higher combustion efficiency than flames generated by flame holes with vertical outlet sections (where the axis passing through the geometric centre of gravity of the outlet section at right angles to the latter is horizontal). The Applicant has found that the combustion efficiency is approximately 10% higher. Combustion efficiency means the ratio between the heat transferred to the cooking pan over the flame and the quantity of heat made available by the burner.

The first and/or the second flame divider means 310, 41 are advantageously situated at almost the same level as the top cover 2 of the cooking top 1. Thus, the means that support the cooking pans may be lower down relative to the top cover 2 of the cooking top 1. First and second flame divider means 310, 41 that are lower down than in traditional burners where the flame holes have vertical outlet sections is, moreover, perfectly in line with current designer trends in favour of simple geometrical figures defined by essential and unobtrusive forms.

The outlet sections of the second flame outlets 340 together define a second crown 321. The second crown 321 may be circular or polygonal, whether open or closed, or any other suitable shape, as described above in connection with the first crown 32. Alternatively, (this solution not being illustrated), the outlet sections of the second flame outlets 340 together define a full surface such as a circle, for example.

In this text, the term "primary air" means the air mixed with the fuel gas inside the gas burner, while the term "secondary air" means the air added to the air-gas mixture already formed in the area outside the cooking top 1 in order to optimize combustion by providing an additional supply of oxygen.

The cooking top 1 comprises a first conduit 5 for feeding the mixture of primary air and fuel gas to the first flame divider means 310 and a second conduit 51 for feeding the mixture of primary air and fuel gas to the second flame divider means 41. The first conduit 5 is separate and independent of the second conduit 51. Advantageously, the first flame divider means 310 are made as a single part. The second flame divider means 41 are also made as a single part.

The outlet sections of the first flame outlets 34 are formed entirely on a single part. The outlet sections of the second flame outlets 340 are formed entirely on a single part. The edge of the outlet sections of the first and/or second flame outlets 34, 340 is made as single, uninterrupted part. In a first solution, the outlet sections of the first and/or second flame outlets 34, 340 are substantially parallel to the top cover 2.

Alternatively, the outlet sections of the first and/or second flame outlets 34, 340 are at least partly inclined at an angle to the top cover 2.

Advantageously, the first flame divider means 310 and/or the second flame divider means 41 comprise a dense distribution of flame outlets 34.

Preferably, the distribution of the outlet sections of the first and/or second flame outlets 34, 340 in the first and/or second flame divider means 310, 41 has a regular pattern so as to better distribute the heat on the bottom of the cooking pans, thus cooking the food inside the pans more uniformly.

In a non-limiting example embodiment, the density of the outlet sections of the first and/or second flame outlets 34, 340 in the first and/or second crowns 32, 321 is between 1 and 10 outlet sections per $cm^2$. The outlet sections of the first flame outlets 34 and the outlet sections of the second flame outlets 340 must not be spaced too widely so as to facilitate the propagation of the flame front when igniting. At the same time, however, they must not be spaced too closely so that the individual flames do not interfere with each other, allowing a sufficient supply of secondary air to reach the flames that are located furthest away from the from the perimetric areas of the first and/or the second crown 32, 321.

Advantageously, the outlet sections of the first flame outlets 34 are distributed more densely in the outer peripheral portion of the first crown 32.

The first flame divider means 310 comprise a first sheet 311. The first sheet 311 comprises first flame holes that coincide with the first flame outlets 34. The second flame divider means 41 comprise a second sheet 312. The second sheet 312 comprises second flame holes that coincide with the second flame outlets 340. The first and/or the second sheet 311, 312 is/are made of steel, preferably stainless steel, or of any other suitable metallic material, such as, for example, brass, inconel or aluminium. Alternatively, the first and/or the second sheet is/are made of a non-metallic material as, for example, a ceramic material. The thickness of the first sheet 311 depends on the type of material used and on the diameter of the flame holes made in this first perforated sheet 311. In the preferred case where the diameter of the flame holes is between 0.7 mm and 2 mm, the first sheet 311 is preferably between 0.7 mm and 1.2 mm thick, this being a good compromise between the mechanical strength required of the first and/or second sheet 311, 312 and the load losses that occur in the air-gas mixture as it flows through the first and/or second sheet 311, 312.

Alternatively, the first flame divider means 310 comprise a first fibrous membrane made from metal, metal alloy, ceramic or carbon fibres or a first porous membrane made from a ceramic, composite or metal material. In a specific embodiment, the second flame divider means 41 comprise a second fibrous membrane made from metal, metal alloy, ceramic or carbon fibres or a second porous membrane made from a ceramic, composite or metal material.

Patent literature discloses numerous examples of such membranes made from metallic fibres: for example, but without limiting the scope of the invention, the membranes described in patent applications WO94/14608, WO95/27871 and WO02/99173 may be considered suitable for the cooking top 1 according to this invention.

The first crown 32 and/or the second crown 321 comprise/comprises a plurality of sub-crowns 38. Advantageously, the sub-crowns 38 are concentric.

In particular, the first crown 32 comprises at least four concentric sub-crowns 38. This increases the surface area heated directly by the flames.

The number of concentric sub-crowns 38 in the first and/or the second crown 32, 321 is such as to create an optimum compromise between the need to guarantee an adequate supply of secondary air to all the sub-crowns 38 and the aim of heating the bottom of a pan placed over the first gas burner 3 as uniformly as possible.

Figure 2:
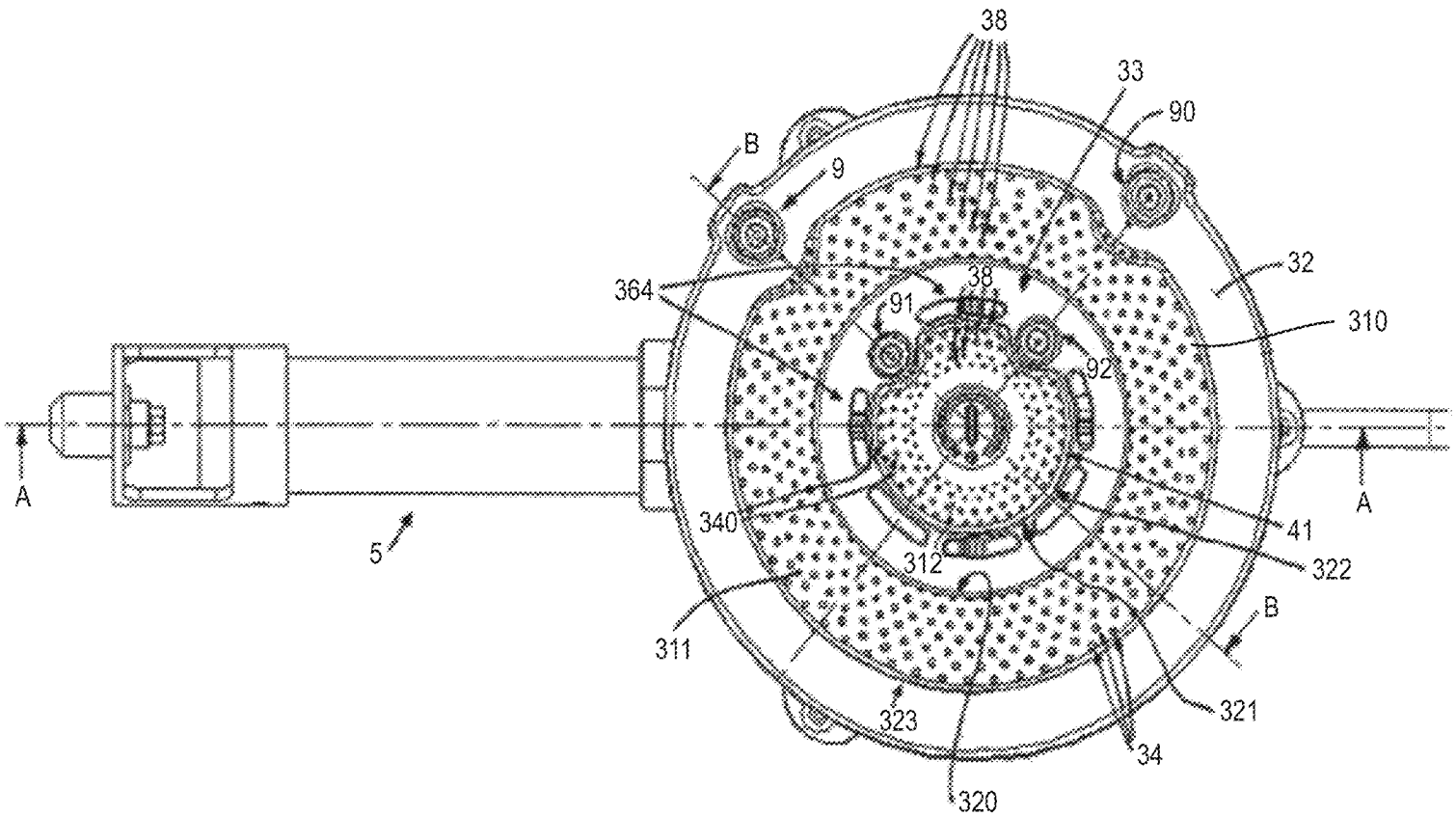
FIG. 2 is a plan view of a detail from FIG. 1.

As illustrated by way of non-limiting example in FIG. 2, the outlet sections of the first flame outlets 34 of two adjacent sub-crowns 38 are offset from each other along the perimetric extension of the sub-crowns 38. Similarly, the outlet sections of the second flame outlets 340 of two adjacent sub-crowns 38 may be offset from each other along the perimetric extension of the sub-crowns 38.

Figure 3:
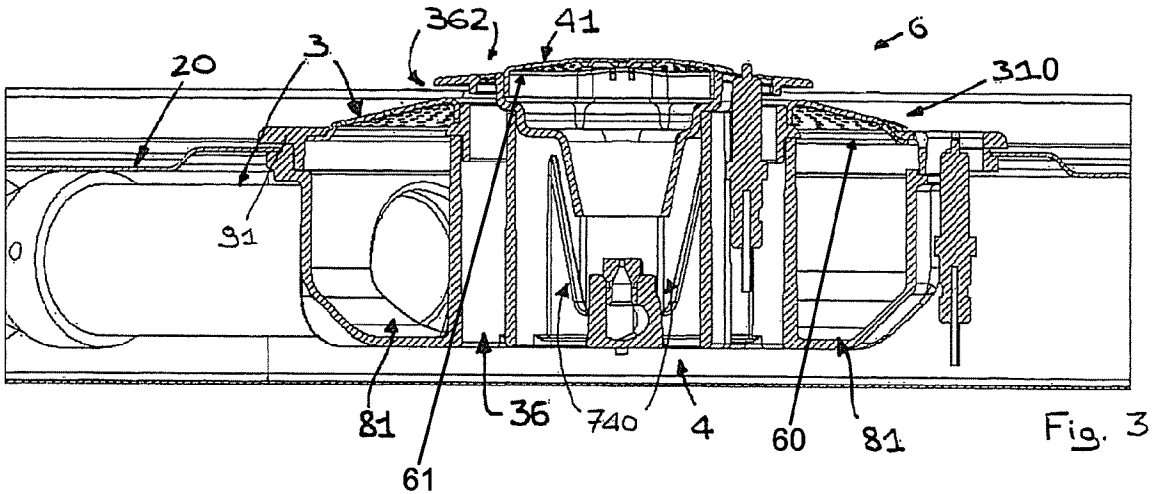
FIG. 3 shows a cross section through the plane B-B of FIG. 2.

Advantageously, the cooking top 1 comprises a relief portion 6 (FIG. 3) that rises above the top cover 2 (FIG. 1); the first flame divider means 310 are made on the slope 60 of the relief portion 6; and the second flame divider means 41 are made on the top 61 of the relief portion 6 (FIG. 3).

The outlet sections of the first and/or the second flame outlets 34, 340 face upwards at an angle of between 0° and 30° to a horizontal plane.

Advantageously, the normals to the outlet sections passing through the geometric centres of gravity of the corresponding outlet sections make with the vertical an angle of between 0° and 30°, preferably an angle of 15°.

This creates a "carpet flame" configuration, that is to say, a flame that propagates outwards in a substantially vertical direction or inclined at a limited angle to the vertical.

Advantageously, the cooking top 1 comprises a conduit 36 for feeding secondary air. This secondary air feed conduit 36 extends at least partially inside the cooking top 1, the secondary air feed conduit 36 extending between an inlet section and a discharge section 362 through which the secondary air escapes to the outside environment. The discharge section 362 is formed between the first and the second flame divider means 310, 41 and makes the secondary air conveyed by the feed conduit 36 available to both the first and the second burner 3, 4. The feed conduit 36 thus provides the first portion 33 with a supply of secondary air independently of the barrier or obstacle created by the individual flames propagating from the first flame divider means 310.

The discharge section 362 comprises a first part 363 that follows an inner edge 320 of the first flame divider means 310 and a second part 364 that follows an outer edge 322 of the second flame divider means 41. Advantageously, the secondary air feed conduit 36 extends at least partially in an area under the top cover 2 or under the first or second flame divider means 310, 41.

The bottom portion of the cooking top 1 comprises a cavity that communicates with the outside environment advantageously through a plurality of openings 83. The inlet section of the secondary air feed conduit 36 communicates with this cavity. The openings 83 are made in a bottom cover 77 of the cooking top 1, this bottom cover 77 being usually referred to as "box" by experts in the trade. Alternatively, if the bottom cover 77 is sealed, the cavity communicates with the outside environment through a plurality of openings made in the top cover 2 of the cooking top 1 (for example, at a control tap of the first burner 3).

In the non-limiting example embodiment illustrated in the accompanying drawings, the first crown 32 is delimited by the inner edge 320 of the first flame divider means 310 and an outer edge 323 of the first flame divider means 310. If the first crown 32 forms a closed loop, the inner edge 320 coincides with the inside perimeter of the first flame divider means 310 and the outer edge 323 coincides with the outside perimeter of the first flame divider means 310. Advantageously, the first crown 32 extends in width between the inner edge 320 and the outer edge 323. More specifically, the first crown 32 comprises a plurality of sub-crowns 38 extending side by side along the width of the first crown 32.

The width of the first crown 32, measured along at least one line joining the inner edge 320 to the outer edge 323, is greater than the dimension measured along that line of a single outlet section of the first flame outlets 34.

Figure 8:
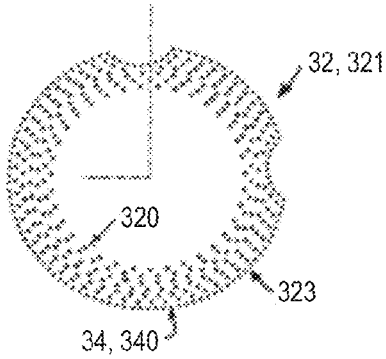
Figure 9:
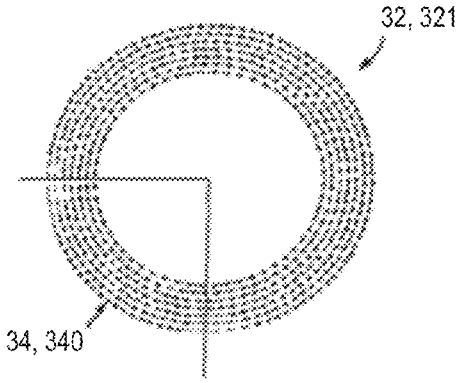

At least one sub-crown 38 at the outer edge 323 of the first flame divider means 310 comprises a larger number of outlet sections of the first flame outlets 34 than the sub-crowns 38 located nearer the inner edge 320 of the first flame divider means 310 (as shown by way of non-limiting example in FIG. 8).

Advantageously, the first flame divider means 310 are made on a first head 31 of the first burner 3, the first head 31 blending in with the top cover 2.

This makes cleaning the top cover 2 and the first flame divider means 310 easier and quicker. With reference to the example embodiments illustrated in the accompanying drawings, the first head 31 comprises the first flame divider means 310 and a connecting ring 901 between the top cover 2 and the perforated sheet 311. Both the top cover 2 and the first flame divider means 310 can easily be dirtied by contact with food and fatty substances during cooking. The smooth, blended connection between the top cover 2 and the first flame divider means 310 enables the user to wipe the cooking top 1 clean with a cloth quickly and easily. There are no difficult to clean corners or narrow gaps.

Moreover, to clean the cooking top 1, there is no need to remove external components or, at most, only a very limited number of components have to be removed, thus saving users of the cooking top 1 a considerable amount of time and significantly increasing the effectiveness of cleaning operations. This is also thanks to the fact that the first flame divider means 310 are made as a single part, as are the second flame divider means 41. The first head 31 forms a single part that can be easily removed and replaced for cleaning (for example to remove stubborn dirt in a dishwasher or specific machine for re-opening clogged up holes).

The cooking top 1 may also comprise pan supporting means, said supporting means being designed to keep the pan containing the food to be cooked at a suitable distance from the top cover 2 of the cooking top 1. The cooking top 1 further comprises interface means designed to enable the operating parameters of each burner to be displayed and adjusted. These interface means may be of different types: for example, they may comprise an electronic interface of the "touch control" type or a mechanical interface with control taps.

The first feed conduit 5 comprises first means 71 for feeding the fuel gas and first means 73 for feeding the primary air into the first gas burner 3. The first fuel gas feed means 71 comprise a first gas feed nozzle 710; and the first primary air feed means 73 comprise first air inlets 730 through which the primary air can flow in. The gas flowing out of the first nozzle 710 at high speed sucks the primary air into the first burner 3 through the first air inlets 730.

For ensuring the largest possible intake of primary air into the first gas burner 3 so as to minimize the secondary air requirement for combustion to take place with a correct stoichiometric ratio, the first air inlets 730 are large enough to allow the primary air to flow through them at an adequate rate. If the air intake created by the outflow of gas through the first nozzle 710 is not sufficient, a primary air forced circulation system may be provided.

The primary air is sucked into the bottom portion of the cooking top 1 which is in fluid communication with the outside environment.

Downstream of the first means 71, 73 for feeding the fuel gas and for feeding the primary air, the first conduit 5 comprises first means 75 for mixing the fuel gas with the primary air. These first mixing means 75 comprise a first Venturi tube 751 into which the mixture of primary air and fuel is drawn. The first Venturi tube 751 may be oriented along a horizontal or vertical plane.

The first Venturi tube 751, besides optimizing the mixture of air and gas prevents the negative pressure created by the first nozzle 710 from causing disturbances downstream (for example, backdraft).

To reduce system size and when low powered units are sufficient, the first mixing means 75 may comprise a first divergent tube instead of the first Venturi tube 751.

The first mixing means 75 of the first burner 3 comprise a first structure 8 defining a first chamber 81 where mixing of the gas and the primary air is completed. This first chamber 81 is advantageously located downstream of the first Venturi tube 751 or of the first divergent tube.

To optimize distribution of the primary air and fuel gas mixture in the first chamber 81, a flow baffle 86 is positioned at the inlet of the first Venturi tube 751 in such a way as to be struck directly by the flow discharged from the first Venturi tube 751. The flow baffle 86 preferably forms a single part with the first structure 8.

The first chamber 81 is substantially axisymmetric. The top part of the first chamber 81 is defined by the first flame divider means 310. The first flame divider means 310 are also substantially axisymmetric and coaxial with the first chamber 81.

At the first flame divider means 310, the cooking top 1 comprises a first ignition plug 9 which creates an electric spark that ignites the mixture of air and fuel gas. At the first flame divider means 310, the cooking top 1 also comprises a first temperature detector 90 which interrupts the gas supply when the temperature falls below a defined minimum value, as when combustion of the air and gas mixture is extinguished.

At the second flame divider means 41, the cooking top 1 comprises a second ignition plug 91 which creates an electric spark that ignites the mixture of air and fuel gas. At the second flame divider means 41, the cooking top 1 also comprises a second temperature detector 92 which interrupts the gas supply when the temperature falls below a defined minimum value, as when combustion of the air and gas mixture is extinguished. In one particular embodiment, the first and the second ignition plugs 9 and 91 may coincide. Similarly, in one particular embodiment, the first and the second temperature detectors 90 and 92 may coincide.

The second feed conduit 51 comprises second means 72 for feeding the fuel gas, second means 74 for feeding the primary air and second mixing means 76.

The second fuel gas feed means 72 comprise a second gas feed nozzle 720; and the second primary air feed means 74 comprise air inlets 740 through which the primary air can flow into the second burner 4. The gas flowing out of the second nozzle 720 at high speed sucks the primary air into the second burner 4 through the second air inlets 740.

Downstream of the second means 72 for feeding the fuel gas and primary air, the second feed conduit 51 comprises second means 76 for mixing the fuel gas and the primary air. These second mixing means 76 comprise a second Venturi tube into which the mixture of primary air and fuel is drawn. The second Venturi tube may be oriented along a horizontal or vertical plane.

The second Venturi tube, besides optimizing the mixture of primary air and gas prevents the negative pressure created by the second nozzle 720 from causing disturbances downstream (for example, backdraft).

To reduce system size and when low powered units are sufficient, the second mixing means 76 may comprise a second divergent tube 762 instead of the second Venturi tube.

The second mixing means 76 also comprise a second structure 80 defining a second chamber 82 where mixing of the gas and the primary air is completed. This second chamber 82 is advantageously located downstream of the second Venturi tube or of the second divergent tube 762. The second chamber 82 where mixing of the gas and the primary air is completed is advantageously surrounded by the first chamber 81 of the first burner 3. The first and the second chambers 81, 82 are independent and separate from each other.

Figure 5:
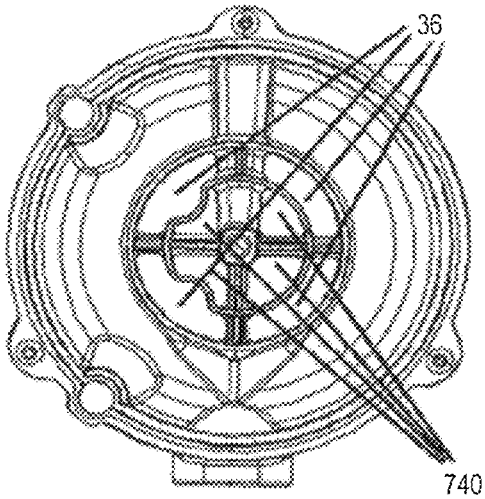
FIG. 5 is a top view of a component of the cooking top.

FIG. 5 shows a top view of the cooking top 1 with the second structure 80 cut away in order to better illustrate how the feed conduit 36 internally delimits the second air inlets 740.

Figure 4:
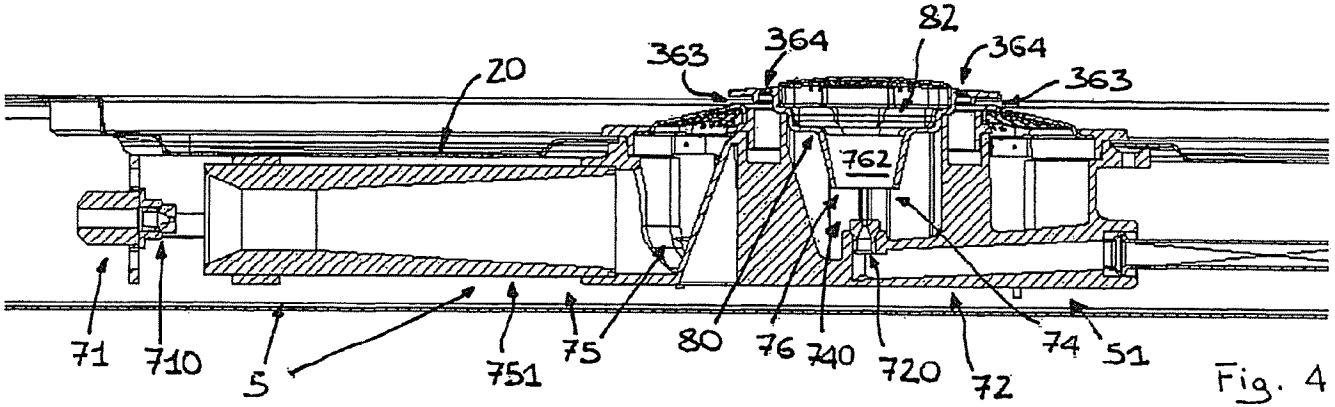
FIG. 4 shows a cross section through the plane A-A of FIG. 2.

As illustrated by way of example in FIGS. 3 and 4, the first and the second burners 3, 4 are fuelled independently of one another. The first and the second burners 3, 4 may be controlled independently of one another, thus requiring a pair of control taps, or they may be controlled using a single control tap.

The second means 72 for feeding the fuel gas and 74 for feeding the primary air are respectively independent of the first means 71, 73 for feeding the fuel gas and the primary air. Upstream of the first and second means 71, 72 for feeding the fuel gas, a single source of fuel gas is advantageously provided.

Advantageously, the cooking top 1 may comprise a plurality of cooking points, normally variable in number between 2 and 6. The term "cooking point" means a defined area where food can be cooked. Normally, only one of the cooking points of the cooking top 1 comprises both the first and the second burner 3 and 4, a cooking point of this kind being very powerful and specific for certain uses.

The invention brings important advantages.

First of all, it enables food to be cooked uniformly.

Another important advantage is that it increases the power of the cooking point and therefore allows food to be cooked more quickly. Further, since the two gas burners can be controlled independently, the power can be used in a more flexible manner, according to the quantity and/or type of food to be cooked and/or the type of cooking pans used. In particular, power of between 0.4 kW and 1 kW can be obtained using only the second burner (that is, the inner one), power of between 1 kW and 4 kW can be obtained using only the first burner (that is, the outer one) and power up to 5 kW can be obtained using both burners simultaneously.

A no less important advantage is that the higher power obtainable does not affect the size of the cooking top.

The invention can be modified and adapted in several ways without thereby departing from the scope of the inventive concept.

Moreover, all details of the invention may be substituted by other technically equivalent elements.

In practice, the embodiments of the invention may be made from any material, and in any size, depending on requirements.

The invention claimed is:

1. A cooking top, in particular a cooking top suitable for household use, comprising:

an upward facing top cover;

a first gas burner in turn including a first flame divider means that puts the first gas burner in operative communication with the outside of the top cover, said first flame divider means including first flame outlets in turn including outlet sections, the outlet sections of the first flame outlets having an upward orientation and together defining a first crown that defines and at least partly surrounds a first portion of the cooking top, wherein the first flame divider means resides on a slope of a relief portion rising above the top cover;

a second gas burner in turn comprising a second flame divider means that puts the second gas burner in operative communication with the outside of the top cover, said second flame divider means including second flame outlets in turn including outlet sections having the upward orientation, the second flame divider means being formed in the first portion of the cooking top, wherein the second flame divider means resides on a top portion of the relief portion, and wherein operation of the first gas burner and second gas burner are controlled independently of each other;

a first sheet of the first flame divider means including first flame holes that coincide with the first flame outlets;

a second sheet of the second flame dividers means including second flame holes that coincide with the second flame outlets;

a first conduit for feeding a mixture of primary air and fuel gas to the first flame divider means; and a second conduit for feeding the mixture of primary air and fuel gas to the second flame divider means, wherein the first conduit being separate and independent of the second conduit.

2. The cooking top according to claim 1, wherein the outlet sections of the second flame outlets together define a second crown.

3. The cooking top according to claim 1, wherein one or both of the first flame divider means and the second flame divider means are each made as a single part.

4. The cooking top according to claim 1, wherein the outlet sections of the first flame outlets are formed entirely on a single part.

5. The cooking top according to claim 1 wherein the outlet sections of the second flame outlets are formed entirely on a single part.

6. The cooking top according to claim 2 wherein one or both of the first crown and the second crown includes a plurality of concentric sub-crowns.

7. The cooking top according to claim 1 wherein the outlet sections of one or both of the first and the second flame outlets face upwards at an angle of between 0° and 30° to a horizontal plane.

8. The cooking top according to claim 1 further comprising a conduit for feeding secondary air, the conduit extending at least partially inside the cooking top and between an inlet section and a discharge section through which the secondary air escapes to the outside environment, with the discharge section being formed between the first flame divider means and the second flame divider means and making the secondary air conveyed by the conduit available to both the first gas burner and the second gas burner.

9. The cooking top according to claim 8 wherein the discharge section comprises:

a first part that follows an inner edge of the first flame divider means, and a second part that follows an outer edge of the second flame divider means.

10. The cooking top according to claim 1 wherein the first flame divider means are made on a first head of the first gas burner, the first head blending in with the top cover.

11. A cooking top, in particular a cooking top suitable for household use, comprising:

an upward facing top cover;

a first gas burner in turn including a first flame divider means that puts the first gas burner in operative communication with the outside of the top cover, said first flame divider means including first flame outlets in turn including outlet sections, the outlet sections of the first flame outlets having an upward orientation and together defining a first crown that defines and at least partly surrounds a first portion of the cooking top, wherein the first flame divider means resides on a slope of a relief portion rising above the top cover;

a second gas burner in turn including a second flame divider means that puts the second gas burner in operative communication with the outside of the top cover, said second flame divider means including second flame outlets in turn including outlet sections having the upward orientation, the second flame divider means being formed in the first portion of the cooking top, wherein the second flame divider means resides on a top portion of the relief portion, and wherein the first gas burner and the second gas burner are separate and controlled independently of each other;

said first flame divider means including a first sheet having first flame holes that coincide with said first flame outlets and said second flame divider means including a second sheet having second flame holes that coincide with said second flame outlet;

a first conduit for feeding a mixture of primary air and fuel gas to the first flame divider means; and a second conduit separate and independent of the first conduit for feeding the mixture of primary air and fuel gas to the second flame divider means.

12. The cooking top according to claim 11 further comprising a conduit for feeding secondary air, the conduit extending at least partially inside the cooking top and between an inlet section and a discharge section through which the secondary air escapes to the outside environment, with the discharge section being formed between the first flame divider means and the second flame divider means and making the secondary air conveyed by the conduit available to both the first gas burner and the second gas burner.

13. The cooking top according to claim 12 wherein the discharge section comprises a first part that follows an inner edge of the first flame divider means, and a second part that follows an outer edge of the second flame divider means.

14. The cooking top according to claim 11 wherein the first flame divider means are made on a first head of the first burner, the first head blending in with the top cover.

15. A cooking top, comprising:

an upward facing top cover;

a first gas burner in turn including a first flame divider means that puts the first gas burner in operative communication with the outside of the top cover, said first flame divider means including first flame outlets in turn including outlet sections, the outlet sections of the first flame outlets having an upward orientation and together defining a first crown that defines and at least partly surrounds a first portion of the cooking top, wherein the first flame divider means resides on a slope of a relief portion rising above the top cover;

a second gas burner in turn including a second flame divider means that puts the second gas burner in operative communication with the outside of the top cover, said second flame divider means being concentric and contiguous with the first flame divider means and including second flame outlets in turn including outlet sections having the upward orientation, the second flame divider means being formed in the first portion of the cooking top, wherein the second flame divider means resides on a top portion of the relief portion, wherein the first gas burner and the second gas burner are separate and controlled independently of each other, and wherein one or both of the first flame divider means and the second flame divider means are made as a single part;

wherein the first flame divider means including a first sheet having first flame holes that coincide with the first flame outlets; and wherein the outlet sections of one or both of the first and second flame outlets face upwards.

16. The cooking top according to claim 1, wherein power between 0.4 kW and 1 kW can be obtained using only the second gas burner, power of between 1 kW and 4 kW can be obtained using only the first gas burner, and up to 5 kW can be obtained using both the first gas burner and the second gas burner simultaneously.

* * * * *

UNITED STATES PATENT AND TRADEMARK OFFICE

CERTIFICATE OF CORRECTION

PATENT NO. : 8,683,991 B2
APPLICATION NO. : 12/528556
DATED : April 1, 2014
INVENTOR(S) : Alberto Gasparini It is certified that error appears in the above-identified patent and that said Letters Patent is hereby corrected as shown below:

In the Claims:
Claim 1, col. 8, line 53 should read:
~~a seond sheet of the second flame dividers means including first~~
a second sheet of the second flame divider means including first Signed and Sealed this
Seventeenth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,683,991 B2
APPLICATION NO. : 12/528556
DATED : April 1, 2014
INVENTOR(S) : Alberto Gasparini It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 228 days.

Signed and Sealed this
Twenty-ninth Day of September, 2015

Michelle K. Lee

Michelle K. Lee
*Director of the United States Patent and Trademark Office*